US006447358B1

(12) United States Patent
Mikkelsen et al.

(10) Patent No.: US 6,447,358 B1
(45) Date of Patent: Sep. 10, 2002

(54) TOY BUILDING SET

(75) Inventors: Kaj S. Mikkelsen; Hans Damgård Nielsen; Kim Pagel; Carsten RØN, all of Billund; Erik Fuglsang, Kolding; Erik Bach, Billund, all of (DK)

(73) Assignee: Interlego AG, Baar (CH)

( * ) Notice: Subject to any disclaimer, the term of this patent is extended or adjusted under 35 U.S.C. 154(b) by 0 days.

(21) Appl. No.: 09/807,598

(22) PCT Filed: Oct. 13, 1999

(86) PCT No.: PCT/DK99/00547

§ 371 (c)(1),
(2), (4) Date: Sep. 10, 2001

(87) PCT Pub. No.: WO00/21630

PCT Pub. Date: Apr. 20, 2000

(51) Int. Cl.[7] ..... A63H 33/04

(52) U.S. Cl. ..... 446/85; 446/102; 446/104; 446/116; 446/120; 446/121; 403/161; 403/163; 403/164; 403/165; 16/260

(58) Field of Search ..... 446/120, 121, 446/102, 104, 116, 119, 106, 108, 123, 86, 381; 403/156, 159, 163

(56) References Cited

U.S. PATENT DOCUMENTS 5,049,104 A 9/1991 Olsen
5,172,534 A * 12/1992 Milner et al. ..... 52/593
5,582,488 A 12/1996 Dudley et al.
5,645,463 A * 7/1997 Olsen ..... 446/104

FOREIGN PATENT DOCUMENTS

| | | |
|---|---|---|
| FR | 2 534 484 | 4/1984 |
| GB | 2 160 114 | 12/1985 |
| GB | 2 220 367 | 1/1990 |
| GB | 2 288 551 | 10/1995 |
| WO | WO 98/30808 | 7/1998 |

* cited by examiner

*Primary Examiner*—Derris H. Banks
*Assistant Examiner*—Ali F. Abdelwahed
(74) *Attorney, Agent, or Firm*—Pitney, Hardin, Kipp & Szuch LLP

(57) ABSTRACT

A toy building set comprising a plurality of building elements which each are provided with hinge parts, a first type of hinge parts comprising a substantially cylindrical rod-shaped shaft part of a building element, a second type of hinge parts comprising a claw device consisting of two elastic fingers extending outwards from a building element at a distance from each other, so that the two elastic fingers between them form a track which is narrowed at the distal end of the fingers with respect to the building element, so that the rod-shaped shaft part may be pressed into the track through the narrowed part of the track, said hinge parts additionally comprising a third type of hinge parts being provided with a shaft stud which has an external diameter corresponding to the thickness of the rod-shaped shaft part.

5 Claims, 3 Drawing Sheets

TOY BUILDING SET

The present invention relates to a toy building set comprising a plurality of building elements which each is provided with at least one hinge part of a plurality of hinge parts comprising a first type of hinge parts and a second type of hinge parts, said first type of hinge parts comprising a cylindrical rod-shaped shaft part extending uninterruptedly between two flanges of a building element, said second type of hinge parts comprising a claw device consisting of two elastic fingers extending outwards from a building element at a distance from each other so that the two elastic fingers between them form a track which is narrowed at the distal end of the fingers with respect to the building element, said rod-shaped shaft part having a thickness greater than the width of the narrowed part of the track so that the rod-shaped shaft part may be pressed into the track through the narrowed part of the track, whereby the fingers are deformed elastically from each other and hold the shaft part in such a manner that, when pressed into the track, it is mounted rotatably about its longitudinal axis in the track.

Such hinge parts are known from e.g. U.S. Pat. No 5,582,488, and are suitable for situations where a good holding force is desired between the hinge parts, as a relatively great force is required to insert the rod-shaped shaft part into the track, and as, subsequently, it Is possible to achieve a high friction between the two hinge parts after the assembly.

From U.S. Pat. No. 5,049,104 another system is known, comprising building elements having hinge parts for forming a releasably hingedly connection between two such elements. One of the hinge parts according to U.S. Pat. No. 5,049,104 is formed as a truncated cone and the other hinge part is adapted for releasably receiving the truncated cones by elastic movement of at least one part of the building elements so as to form a hinge connection. The system is furthermore provided with clamp means for blocking the elastic movement and thereby fixing the interconnecting hinge parts.

Accordingly, the object of the present invention is to provide a toy building set of the type mentioned in the opening paragraph, which, with a few subcomponents, allows selective building of hinge functions with a high friction and holding force, and which additionally allows building of hinge functions which do not require a great friction, and which do not require the same force to interconnect the hinge parts.

This is achieved according to the invention in that the hinge parts additionally comprise a third type of hinge parts, which comprises two elastic parallel female flanges extending at a mutual distance outwards from a building element, and that each of the female flanges, on the side facing the parallel female flange, is provided with a shaft stud which has an external diameter corresponding to the thickness of the rod-shaped shaft part.

As a result, two types of hinges may be built using just three hinge elements, different with respect to the hinge parts themselves, of a building set. A first type which involves a relatively great friction between the hinge parts after the assembly of these since just the one hinge part with the fingers is deformed, and a second type where the friction between the hinge parts is considerably smaller since both the one hinge part and the other hinge part are deformed elastically by the assembly of the hinge parts.

In a preferred embodiment, the shaft studs are shaped as truncated cones whose tapering ends face each other, and whose largest diameter is larger than the width of the track at the narrowing. This facilitates the assembly of the hinge parts considerably, as the inclined faces on each of the shaft studs serve as guide faces so that less force is required to deform the fingers and the female flanges during the assembly.

In addition, it is particularly advantageous if the two fingers have a width which corresponds to the distance between the female flanges. It is ensured hereby that the engagement of the female side faces against the fingers prevents the hinge link from being upset unintentionally.

A particularly good and uniform friction between the hinge links is achieved in that the track is shaped as a circular-cylindrical face at the opposite end with respect to the narrowing.

Even more advantageously, if the circular-cylindrical part of the track has a diameter which is smaller than the largest diameter of each of the shaft studs, a certain friction is achieved between the shaft studs and the track after the assembly of the hinge parts.

The invention will be described more fully below with reference to the drawing, in which FIG. 1 is a view showing a first building element according to the invention, seen from above.

Figure 1:
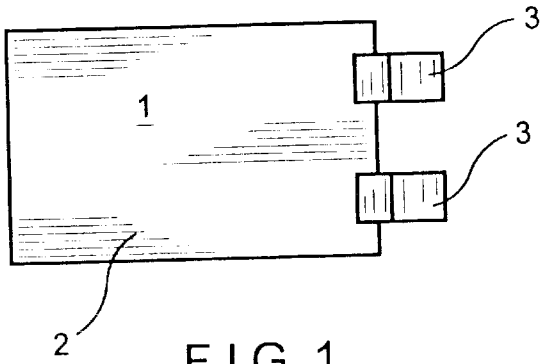

FIG. 1 shows a building element 1 having a body part 2 which is provided with two claw devices 3 positioned at the side of each other.

Figure 2:
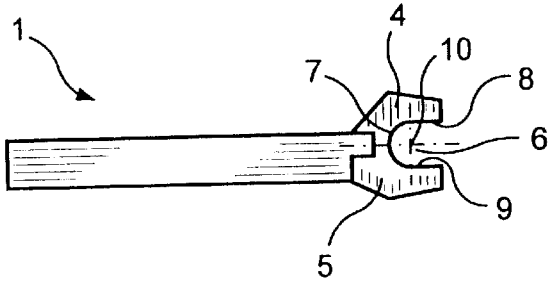
FIG. 2 is a view of the building element shown in FIG. 1, seen from the side.

FIG. 2 shows the same element as is shown in FIG. 1, but it will be seen here that each of the claw devices 3 has two fingers 4, 5 defining a track 6 which is formed with a circular-cylindrical face 7 at the bottom, and which is provided with a pair of faces 8, 9 at the other end, which are spaced from each other and form a passage in the track 6 narrowed with respect to he circular-cylindrical face 7. The claw devices may hereby easily receive a shaft-like device on another building element and hold it rotatably between the fingers 4, 5, thereby providing a hinge function with a hinge axis 10 common to the two building elements.

Figure 3:
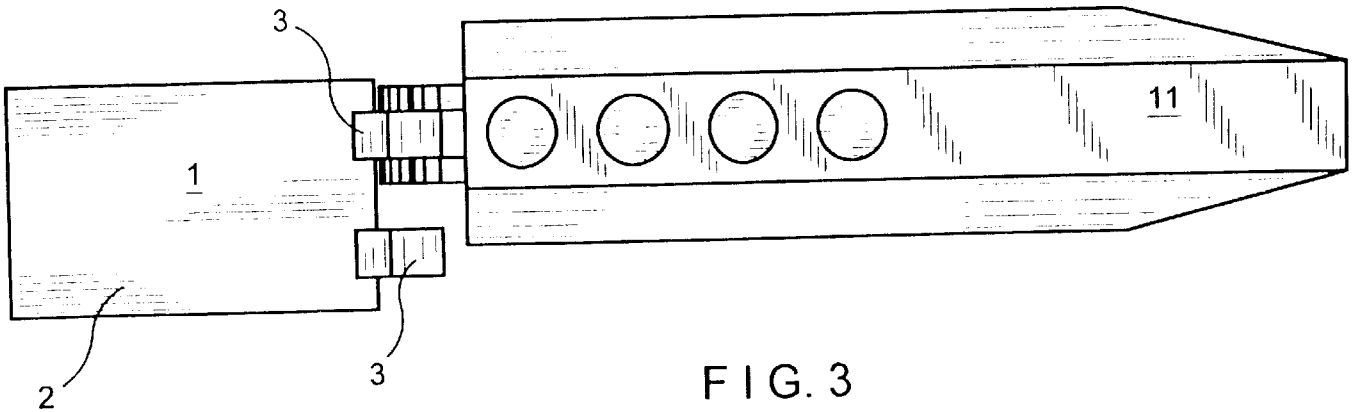
FIG. 3 is a view showing the building element shown in FIGS. 1 and 2 mounted on a second building element.

It appears from FIG. 3 that the building element 1 shown in FIGS. 1 and 2 may be mounted on hinge parts provided on a second building element 11; according to the invention, this second building element 11 may be provided with two different hinge parts allowing two different hinge functions to be built.

Figure 4:
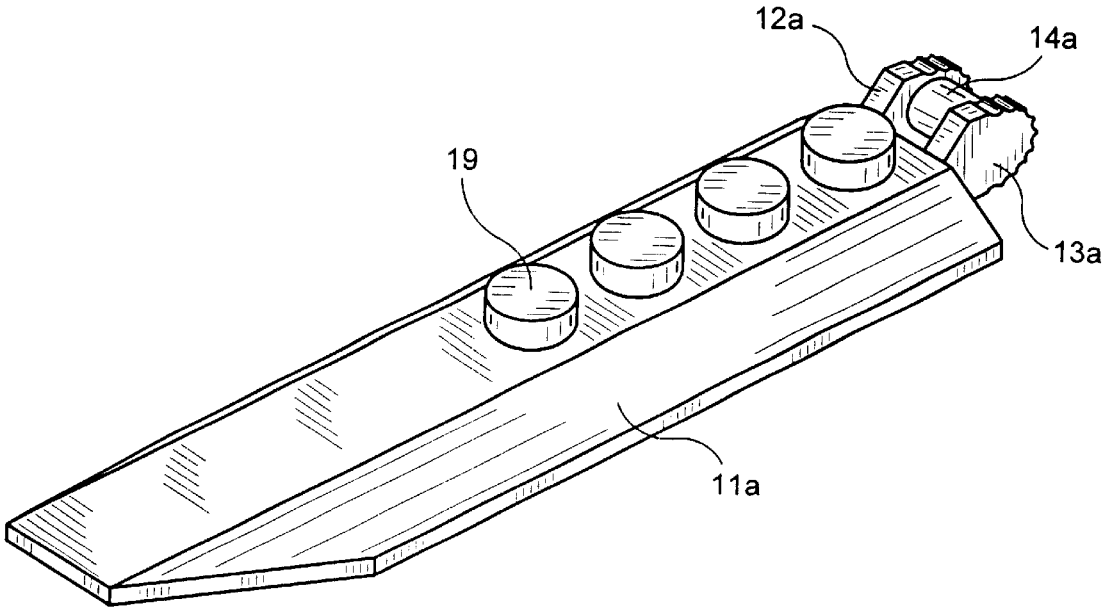
FIG. 4 is a perspective view showing a first embodiment of the second building element shown in FIG. 3, seen obliquely from above.
Figure 5:
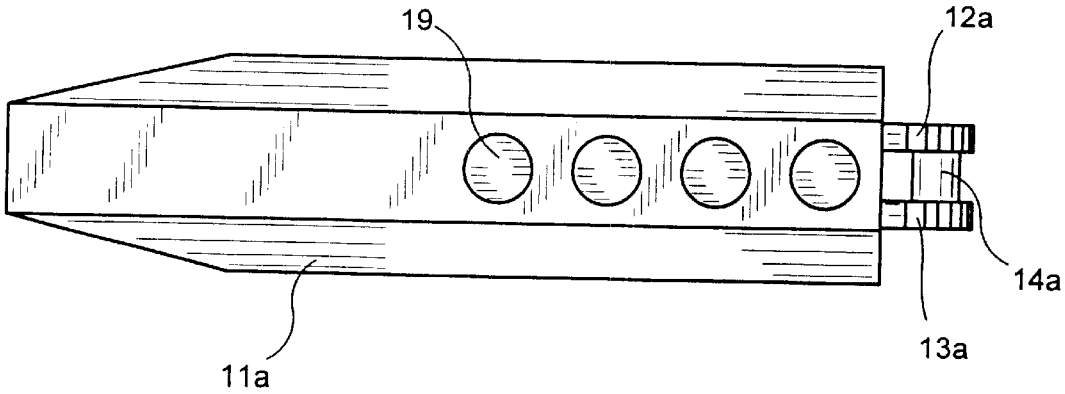
FIG. 5 is a view showing the building element shown in FIG. 4, seen from above.

FIGS. 4 and 5 are views in perspective and straight from above, respectively, of a first embodiment 11*a* of the second building element shown in FIG. 3; according to the invention, this first embodiment 11*a* is provided with a first type of hinge parts comprising two female flanges 12*a*, 13*a* between which a circular-cylindrical shaft 14*a* is provided, said shaft having a thickness greater than the width of the track 6 of the element. shown in FIGS. 1 and 2, but not too great for the shaft to be pressed into the track 6 between the fingers 4 and 5 without these being deformed plastically.

When the shaft is then pressed completely into the track 6, the circular-cylindrical shaft 7 will hold the shaft which may then be rotated about the common hinge axis 10 shown in FIG. 2, thereby forming a hinge function.

Interconnection of the building element 1 shown in FIGS. 1 and 2 and of the building element 11*a* shown in FIGS. 4 and 5 thus results in a hinge function which provides a relatively high friction and holding force, since just the fingers 4, 5 of the one building element 1 are deformed plastically by the assembly.

Figure 6:
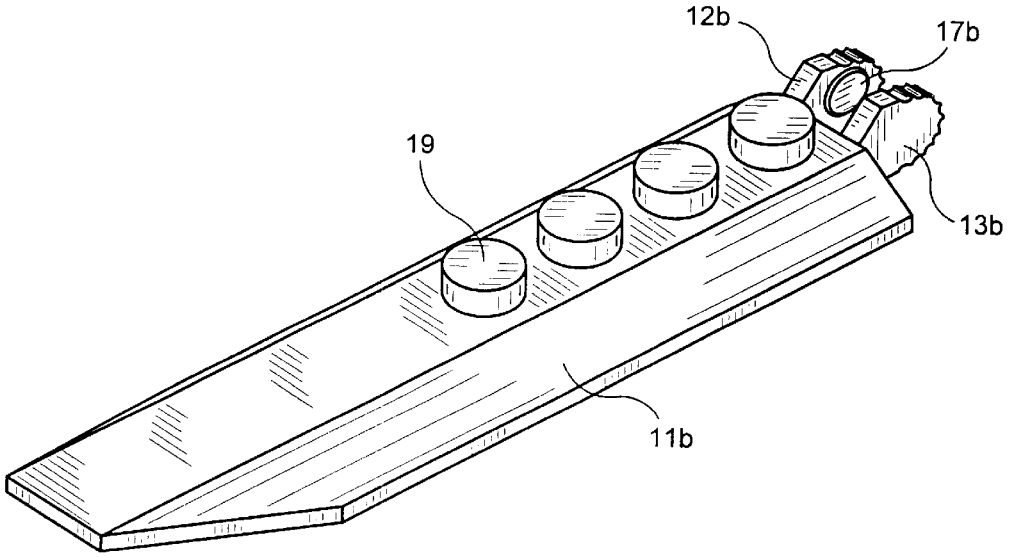
FIG. 6 is a perspective view showing a second embodiment of the second building element shown in FIG. 3, seen obliquely from above.
Figure 7:
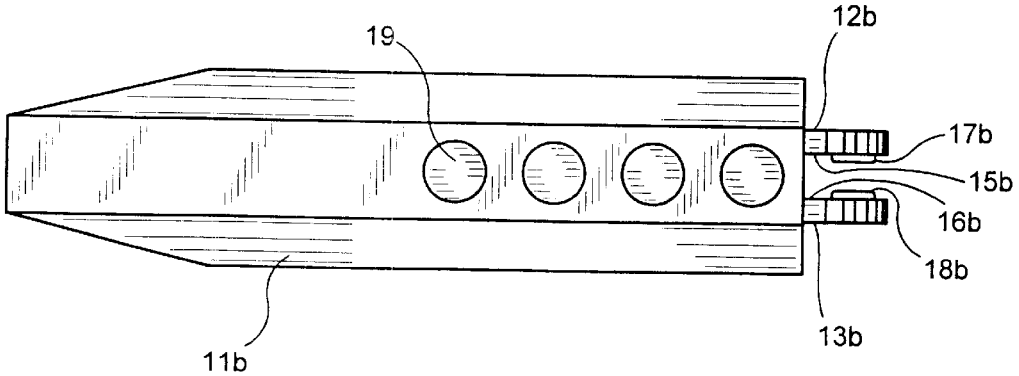
FIG. 7 is a view showing the building element shown in FIG. 6, seen from above.

FIGS. 6 and 7 show a second embodiment 11*b* of the building element 11 shown in FIG. 3 according to the invention; according to the invention, this second embodiment 11*b* is provided with a first type of hinge parts comprising two female flanges 12*b*, 13*b* which each have a female side face 15*b*, 16*b* which is formed with a shaft stud 17*b*, 18*b* shaped as a frustum of a cone having a largest diameter which is larger than the width of the track 6 of the element shown in FIGS. 1 and 2, but not too large for the shaft studs to be pressed into the track 6 between the fingers 4 and 5, without the fingers 4 and 5 or the female flanges 12*b*, 13*b* being deformed plastically. When the shaft studs 17*b*, 18*b* have then been pressed completely into the track 6, the circular-cylindrical face 7 will hold the shaft studs 17*b*, 18*b* which may then be rotated about the common hinge axis 10 shown in FIG. 2, thereby providing a hinge function.

Thus, interconnection of the building element 1 shown in FIGS. 1 and 2 and of the building element 11*b* shown in FIGS. 6 and 7 results in a hinge function which provides a relatively low friction and holding force, since both the fingers 4, 5 of the building element 1 and the female flanges 12*b*, 13*b* of the building element 11*b* are deformed plastically by the assembly.

As will be seen, the building elements of the building system, as shown in FIGS. 4 to 7, may be provided with coupling studs 19 for the mounting of other building elements in a generally known manner.

We claim:

1. A toy building set comprising a plurality of building elements which each are provided with hinge parts, said hinge parts comprising a first type of hinge parts and a second type of hinge parts, said first type of hinge parts comprising a substantially cylindrical rod-shaped shaft part extending uninterruptedly between two flanges of a building element, said second type of hinge parts comprising a claw device consisting of two elastic fingers extending outwards from a building element at a distance from each other so that the two elastic fingers between them form a track which is narrowed at he distal end of the fingers with respect to the building element, said rod-shaped shaft part having a thickness greater than the width of the narrowed part of the track so that the rod-shaped shaft part may be pressed into the track through the narrowed part of the track, whereby the fingers are deformed elastically from each other and hold the shaft part in such manner that, when pressed into the track, it is mounted rotatably about its longitudinal axis in the track, characterized in that the hinge parts comprise a third type of hinge parts which comprises two elastic substantially parallel female flanges extending at a mutual distance outwards from a building element, and that each of the female flanges, on the side facing the parallel female flange, is provided with a shaft stud which has an external diameter corre-sponding to the thickness of the rod-shaped shaft part.

2. A toy building set according to claim 1, characterized in that the shaft studs are shaped as truncated cones whose tapering ends face each other, and whose largest diameter is larger than the width of the track at the narrowing.

3. A toy building set according to claim 1, characterized in that the two fingers have a width which corresponds to the distance between the female flanges.

4. A toy building set according to claim 1, characterized in that the track is shaped as a circular-cylindrical face at the opposite end with respect to the narrowing.

5. A toy building set according to claim 2, characterized in that the circular-cylindrical part of the track has a diameter which is smaller than the largest diameter of each of the shaft studs.

* * * * *